United States Patent [19]

Holley

[11] 4,140,418

[45] Feb. 20, 1979

[54] TRAFFIC INDICATOR

[76] Inventor: Neil K. Holley, 1729 Bonneville Rd., Bryan, Tex. 77801

[21] Appl. No.: 877,013

[22] Filed: Feb. 13, 1978

[51] Int. Cl.[2] ..... E01F 9/00

[52] U.S. Cl. ..... 404/11

[58] Field of Search ..... 404/11, 10, 9; 40/125 N

[56] References Cited

U.S. PATENT DOCUMENTS

| | | | |
|---|---|---|---|
| 1,845,774 | 2/1932 | Wilson | 404/11 |
| 1,903,739 | 4/1933 | Tatlock | 404/11 |
| 1,915,179 | 6/1933 | Blackwelder | 404/11 |
| 3,134,184 | 5/1964 | Neblett | 404/11 X |

FOREIGN PATENT DOCUMENTS

| | | | |
|---|---|---|---|
| 1164452 | 3/1964 | Fed. Rep. of Germany | 404/11 |
| 1421151 | 1/1976 | United Kingdom | 404/11 |

*Primary Examiner*—Nile C. Byers, Jr.
*Attorney, Agent, or Firm*—Bernard A. Reiter

[57] ABSTRACT

A traffic indicator used in the road has a body movable from an indicating position to a protection position, the body including a first shoulder lying substantially flush with the road surface, and thus in the protecting position, and a second shoulder, having a reflector in it, standing at an angle away from the first shoulder above the road surface and thus residing in the indicating position. A stationary bar extends through the body for supporting it in a recess in the roadway. The bar forms an axle about which the body pivotally moves from the indicating to the protecting position. A spring means is disposed in the body so that the indicator will be urged back to the indicating position after a vehicle has passed over it and caused it to pivot to the protecting position.

13 Claims, 4 Drawing Figures

TRAFFIC INDICATOR

BACKGROUND AND BRIEF SUMMARY OF THE INVENTION

Traffic indicators used in roads are well known. Such indicators commonly use a reflecting lens visible above the surface of the road to act as an indicator. The indication thus visible may be for showing a separation between lanes of traffic or for providing information to the drivers of the vehicles, such as stop signs and street names. Because these reflecting elements may be damaged by the traffic moving over them, such as automobiles, trucks and especially the blades of snow plows, engaging the indicator, some indicators have been designed to be movable from an indicating position, where the reflecting element is seen by the driver of the moving vehicle, to a protecting position, where the reflecting element is recessed into the roadway and protected from the moving traffic.

There have been basically two designs used to solve this problem. One design involves the use of a body with the reflector supported thereon, which is vertically supported on a spring. As the moving vehicle crosses over the reflector body, the spring is depressed downwardly into the protecting position. The spring then moves the body to the indicating position after the vehicle has passed. Some examples of such indicators are given in U.S. Pat. Nos. 1,825,667, 2,981,149, 3,292,506, 3,377,930, 3,850,536 and 3,920,348. A problem with this design is that as the reflector body is depressed, foreign matter may enter from the road surface to prevent the reflector body from returning to the indicating position.

A second design pivotally mounts as an indicator support within the road. The support is pivotally moved from the indicating position, above the road, to a protecting position, level or below the road, as the vehicle moves over the support. The reflector support is then moved back to the indicating position by a counterbalance disposed on the support structure within a housing beneath the road surface. Some examples of this design are given in U.S. Pat. Nos. 1,845,774 and 2,176,285. This design has an advantage over the previously discussed design in that the passage of material from the roadway into the indicator is inhibited and the support is less likely to be prevented from returning to the indicating position. The ability of the reflector support to return to the indicating position after having moved to the protecting position is not always sufficient to adverse conditions because such movement depends on the force of gravity and the weight of the counterbalance.

Accordingly, it is an object of the present invention to provide a traffic indicator used in a road that employs a spring within a pivotally movable body for urging the body into the indicating position after the body has been pivotally moved to the protecting position by the action of vehicles engaging the body when moving past the body.

Further, it is an object of the present invention to provide a traffic indicator used in a road that employs a spring for urging a body into an indicating position after the body has been pivotally moved to a protecting position, the indicator being constructed to prevent the passage of material which might interfere with the pivotal action of the body and prevent proper functioning of the traffic indicator.

In accordance with the invention, a traffic indicator used in a road is employed with a body movable from an indicating position to a protecting position. The body has a first shoulder which lies substantially flush with the road surface in the indicating position and a second shoulder joined to and extending at an angle away from the first shoulder to above the road surface in the indicating position. A stationary bar extends through a passageway within the body for supporting the first shoulder substantially flush with the road surface when the indicator is in the indicating position. The bar extends substantially transverse to the direction of vehicles traveling on the road and forms an axis about which the body pivotally moves from the indicating position to the protecting position. A tab extends from and is held stationary with said bar and the spring is disposed between the body and the tab for urging the body into the indicating position, a moving vehicle engaging said body will thus cause the body to pivot to the protecting position and the spring means will return the body to the indicating position after the vehicle passes the indicator. The indicator is thereby protected from possible damage caused by the moving vehicles.

BRIEF DESCRIPTION OF THE DRAWINGS

Other objects and advantages of the invention will become apparent upon reading the following detailed description and upon reference to the drawings, in which like reference characters are used throughout the designated like parts.

Figure 1:
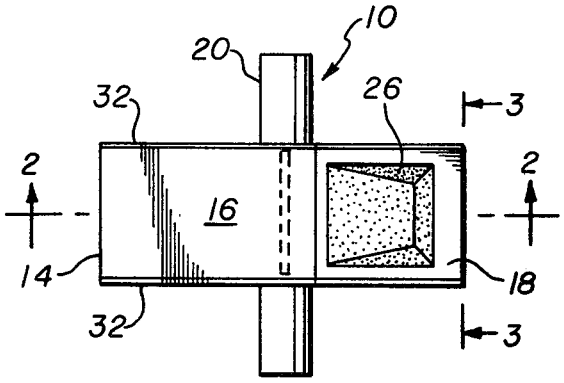
FIG. 1 is a plan view of a traffic indicator constructed according to the present invention.

While the invention will be described in connection with a preferred embodiment, it will be understood that it is not intended to limit the invention to that embodiment. On the contrary, it is intended to cover all alternative modifications and equivalents as may be included in the spirit and scope of the invention as defined by the appended claims.

DETAILED DESCRIPTION OF THE INVENTION

Turning now to the drawings, there is shown a traffic indicator 10 used in a road 12. Traffic indicator 10 includes a body 14 which is movable from an indicating position to a protecting position. Body 14 has first shoulder 16 and a second shoulder 18 and is preferably of circular cross-section with shoulder 16 cutting across the cross-section to form a first surface which is substantially flush with the road surface in the indicating position and shoulder 18 extending at an angle away from first shoulder 16 to a location where the edge of body 12 is above the raod surface in the indicating position.

A stationary bar 20 is disposed within road 12 and extends through a passageway 22 in body 14 for supporting body 14 in road 12 with first shoulder 16 disposed substantially flush with road surface 12 in the indicating position. Bar 20 extends substantially transverse to the direction of vehicular travel along road 12, which is indicated by arrow 24, and forms an axis about which body 14 pivotally moves from the indicating position to the protecting position. Also, second surface 18 and first surface 16 are joined at a location past the pivotal axis formed by bar 20 from the direction the moving vehicles approach body 14 or downstream in the direction of arrow 24.

A reflector 26, which is of conventional design, visible to drivers of vehicles moving along road surface 12 in the direction of arrow 24 is provided on second shoulder 18. Preferably, a recess is provided within shoulder 18 for mounting reflector 26 therein to aid in further inhibiting damage to the reflector caused by moving vehicles.

A tab 28 extends from and is held stationary with bar 20. Preferably, bar 20 is mounted within the laterally extending portion of the inverted "L" of passageway 22 and tab 28 extends down the vertically extending portion of the "L" shaped passageway.

Spring means 30 is disposed between body 14 and tab 28 to urge body 14 into the indicating position after the body has been pivotally moved to the protecting position, a moving vehicle-engaging body 14 will thus cause the body to pivot about bar 20 in the direction of arrow 32 to the protecting position and compress spring means 30 and the spring means will return the body to the indicating position after the vehicle passes indicator 10. Preferably, spring means 30 is a coil spring disposed within passageway 22 of body 14.

As an aid in preventing the passage of material into passageway 22 which might interfere with the pivotal action of body 14, tab 28 extends down the vertically extending portion of the inverted "L" shaped passageway and coil spring 30 is disposed within this portion between body 14 and tab 28. End plates 34 are then attached on each side of the body by conventional apparatus, such as by screws 36, to enclose the passageway. Each plate 34 has an opening 38 through which bar 20 extends into the road. A seal 40 is disposed across opening 38 between bar 20 and each end plate 34 to prevent the passage of material, such as rocks, gravel and sand, into passageway 22 and thereby inhibit the likelihood of interference with the pivotal action of body 14, such as by loding between the coils of the spring.

Figure 2:
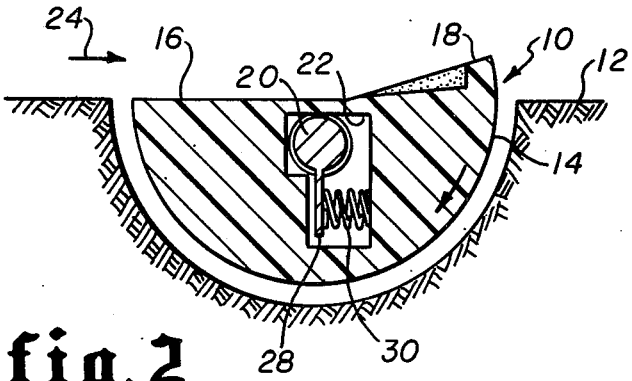
FIG. 2 is a side elevational view taken in the direction of arrows 2—2 of the embodiment of the invention shown in FIG. 1.
Figure 3:
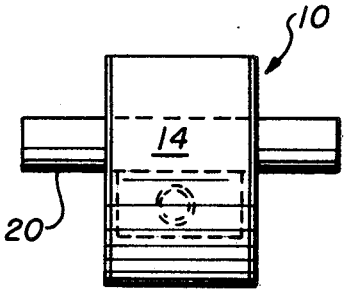
FIG. 3 is an end view of the embodiment of the invention shown in FIG. 1.
Figure 4:
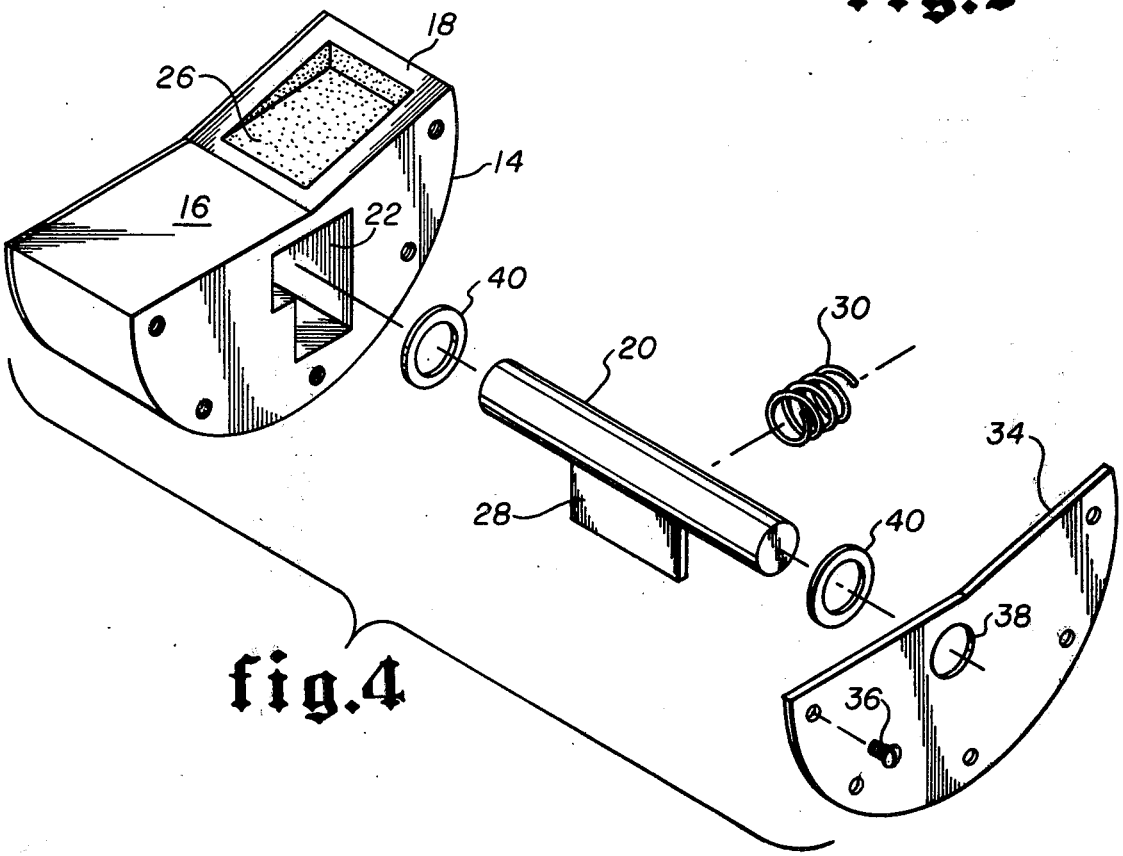
FIG. 4 is a perspective view of the embodiment of the invention shown in FIGS. 1–3 showing the parts thereof in exploded relation to one another.

In operation, as the vehicle approaches in the direction of arrow 24 (FIG. 2) along roadway 12, a portion of the vehicle, such as a blade on a snow plow or a tire, will pass along first shoulder 16 and engage second shoulder 18. Body 14 is thus rotated in the direction of arrow 32 to compress spring 30. As the portion of the vehicle moves off second shoulder 18 spring 30 acts against the vertically extending portion of "L" shaped passageway 20 to urge body 14 into the indicating position.

From the foregoing it will be seen that this invention is one well adapted to attain all the ends and objects hereinabove set forth together with other advantages which are obvious and which are inherent to the apparatus.

It will be understood that certain features and subcombinations are of utility and may be employed with reference to other features and subcombinations. This is contemplated by and is within the scope of the claims.

As many possibly embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A traffic indicator used in a road, comprising:

a body movable from an indicating position to a protecting position having a first shoulder which lies substantially flush with the road surface in the indicating position and a second shoulder extending at an angle away from the first shoulder to a location above the road surface in the indicating position;

a reflecting element visible to drivers of vehicles moving along the road surface provided on the second shoulder of said body;

a stationary bar extending through a passageway in said body for supporting said body in the road with the first shoulder substantially flush with the road surface in the indicating position, said bar extending substantially transverse to the direction of vehicular travel along the road and forming an axis about which said body pivotally moves from the indicating position to the protecting position;

a tab extending from and held stationary with said bar;

spring means disposed between said body and said tab for urging said body into the indicating position;

a moving vehicle engaging said body will thus cause the body to pivot to the protecting position and the spring means will return the body to the indicating position after the vehicle passes the indicator.

2. The indicator of claim 1, wherein said tab and spring means are disposed within the passageway; including side plates attached on each side of said body, each plate having an opening through which said bar extends; and a seal disposed across the passage of material into the passageway which might interfere with the pivotal action of said body.

3. The indicator of claim 2, wherein a recess is provided within the second shoulder of said body and the reflector is disposed within the recess to further inhibit the possibility of damage to the reflector from moving vehicles.

4. The indicator of claim 3, wherein the second surface extends from the first surface at a location past the pivotal axis from the direction the moving vehicles approach said body.

5. In a reflector body adapted to be recessed into a roadway and to be pivotally mounted therein to move from a first operative position to a second protected position when a vehicle passes thereover so that no damage occurs from contact with the vehicle comprising:

a pair of side walls, each having an arcuate defining edge greater than 180° and two radial edges extending to the arcuate edge from a central point thereof, a surface wall connecting the said arcuate defining edges, and a reflector means disposed between at least one pair of opposing radial edges of said side walls, and an axle means perpendicular to said side walls for pivotally supporting the body in the roadway so that contact of vehicle with either radial edges causes the body to pivot to one of said positions.

6. The reflector body of claim 5 wherein a bias means is disposed in operative relationship to the reflector body to urge the reflector means to a position above the surface of the roadway.

7. The reflector body of claim 6 wherein the bias means includes a tab extending from the axle for abutting engagement by a spring means, and a spring means for contacting the tab to urge the reflector body toward its operative position but having sufficient resilience to permit movement of the body to the recessed position in the roadway.

8. A reflector body of semi-circular configuration adapted to be embedded in a roadway but to protrude there above having a reflector on a radially disposed surface and supported on a stationary axle mounted through the center so as to move in pivotal manner thereabout when it is contacted by a passing vehicle, and biasing means disposed in operative relation to the reflector body to urge the reflector body to a position above the surface of the roadway.

9. A traffic indicator used in a road comprising:

a body movable from an indicating position to a protected position having a shoulder which extends at an angle above the road surface, a reflecting element visible to drivers of vehicles moving along the road surface provided on said shoulder, a bar extending through a passageway in said body for supporting said body in the road with said shoulder in the indicating position, said bar extending substantially transverse to the direction of vehicular travel along the road and forming an axis about which said body, pivotally moves from the indicating position to the protected position, biasing means in said passageway urging said body into the indicating position so that a moving vehicle engaging said body will cause the body to pivot to a protected position for the reflector element and the biasing means will return the body to the indicating position after the vehicle passes.

10. The traffic indicator of claim 9 wherein said shoulder is characterized by a recess and said reflector rests therein to thus inhibit the possibility of damage to the reflector from moving vehicles.

11. In a reflector body adapted to be recessed into a roadway and to be pivotally mounted therein to move from a first operative position to a second protected position when a vehicle passes thereover so that no damage occurs from contact with the vehicle comprising:

a pair of side walls, each having an arcuate defining edge and two radial edges extending to the arcuate edge from a point along a common axis, a reflector means disposed between at least one pair of opposing radial edges of said side walls and visible from the roadway when in its operative position, axle means perpendicular to said side walls for pivotally supporting the body in the roadway so that contact of a vehicle with either radial edge causes the body to pivot to one of said positions.

12. The reflector body of claim 11 wherein a bias means is disposed in operative relationship to the reflector body to urge the reflector means to a position above the surface of the roadway.

13. The reflector body of claim 12 wherein the bias means includes a tab extending from the axle for abutting engagement by a spring means, and a spring means for contacting the tab to urge the reflector body toward its operative position but having sufficient resilience to permit movement of the body to the recessed position in the roadway.

* * * * *